US008523410B2

(12) United States Patent
Hashimoto et al.

(10) Patent No.: US 8,523,410 B2
(45) Date of Patent: Sep. 3, 2013

(54) LIGHT SOURCE DEVICE WITH THERMAL DISSIPATING MEMBERS

(75) Inventors: Naotaka Hashimoto, Osaka (JP); Shinya Kawagoe, Osaka (JP); Toshikazu Endo, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/390,318

(22) PCT Filed: Sep. 28, 2011

(86) PCT No.: PCT/JP2011/005484

§ 371 (c)(1), (2), (4) Date: Feb. 13, 2012

(87) PCT Pub. No.: WO2012/101691

PCT Pub. Date: Aug. 2, 2012

(65) Prior Publication Data

US 2012/0224381 A1 Sep. 6, 2012

(30) Foreign Application Priority Data

Jan. 27, 2011 (JP) ..... 2011-015486

(51) Int. Cl.
*F21V 29/00* (2006.01)

(52) U.S. Cl.
USPC ..... 362/373; 362/294

(58) Field of Classification Search
USPC ..... 362/547, 294, 373
See application file for complete search history.

(56) References Cited

U.S. PATENT DOCUMENTS

| | | | | |
|---|---|---|---|---|
| 6,607,290 | B2 * | 8/2003 | Matsuba et al. | 362/294 |
| 7,344,268 | B2 * | 3/2008 | Jigamian | 362/202 |
| 7,717,590 | B1 * | 5/2010 | Li | 362/294 |
| 2002/0024814 | A1 | 2/2002 | Matsuba et al. | |
| 2005/0111234 | A1 * | 5/2005 | Martin et al. | 362/555 |
| 2010/0225220 | A1 | 9/2010 | Tanaka et al. | |
| 2011/0233593 | A1 | 9/2011 | Kawagoe et al. | |
| 2011/0242828 | A1 * | 10/2011 | Blincoe et al. | 362/373 |

FOREIGN PATENT DOCUMENTS

| | | |
|---|---|---|
| JP | 2002-075011 | 3/2002 |
| JP | 2008-159341 | 7/2008 |
| JP | 2009-117342 | 5/2009 |
| WO | 2010/084546 | 7/2010 |

* cited by examiner

*Primary Examiner* — Robert May

(57) ABSTRACT

An LED lamp 10 that is a light source device includes a light emitting module 14, a body 12 that is a first thermal dissipation member onto which the light emitting module 14 is attached, a circuit unit 22 for lighting the light emitting module 14, and a case 24 that is a second thermal dissipation member that has the circuit unit 22 housed therein, and a thermal insulation member 20 is inserted between the body 12 and the case 24.

6 Claims, 4 Drawing Sheets

LIGHT SOURCE DEVICE WITH THERMAL DISSIPATING MEMBERS

TECHNICAL FIELD

The present invention relates to a light source device, and particularly to a light source device including a light emitting element such as an LED and including therein a circuit unit for lighting the light emitting element.

BACKGROUND ART

As a solid-state light emitting element such as an LED increases in temperature during light emission, its light emitting efficiency and life decrease. Also, some of electronic components of a circuit unit for lighting the solid-state light emitting element are damaged or decrease their life due to thermal effects.

In view of this, there is a need for efficient dissipation of heat generated by the LED and the circuit unit. Patent Literature 1 discloses a light source device including a case composed of a cylindrical body, which is made of a material having excellent thermal conduction properties such as aluminum, whose hollow part is partitioned by a plate member made of the same material as the cylindrical body. The plate member is fixed to the cylindrical body in such a state where an edge part of the plate member is folded back in a predetermined width so as to bring an outer circumferential surface of the folded-back edge part into close contact with an internal circumferential surface of the cylindrical body.

On one of surfaces of the plate member, an LED module is mounted, which is composed of a print substrate on which an LED is mounted. On the other surface of the plate member, a circuit unit is housed in the hollow part of the case.

According to the light source device having the above structure disclosed in the Patent Literature 1, heat generated by the LED module during lighting is dissipated via the plate member and the cylindrical body. On the other hand, heat generated by the circuit unit is conducted to the cylindrical body by radiation, convection within the hollow part, or the like, and then is dissipated from an outer surface of the cylindrical body.

CITATION LIST

Patent Literature

[Patent Literature 1] Japanese Patent Application Publication No. 2009-117342

[Patent Literature 2] Japanese Patent Application Publication No. 2002-75011

SUMMARY OF INVENTION

Technical Problem

However, the above light source device causes the following problem because the cylindrical part functioning as a thermal dissipation member is shared between the LED module and the circuit unit.

In the case where the circuit unit during lighting generates a higher heat than that of the LED module for example, most of heat conducted from the circuit unit to the cylindrical body is internally conducted beyond a part of the cylindrical body where the plate member is fixed. This decreases thermal dissipation properties of the cylindrical body for dissipating heat conducted from the LED module.

In view of the above problem, the present invention aims to provide a light source device capable of eliminating thermal effects between a light emitting module and a circuit unit as much as possible so as to ensure thermal dissipation properties of the light emitting module and the circuit unit.

Solution to Problem

In order to achieve the above aim, the present invention provides a light source device comprising: a light emitting module; a first thermal dissipation member onto which the light emitting module is attached; a circuit unit configured to light the light emitting module; and a second thermal dissipation member that has the circuit unit housed therein, wherein a thermal insulation member is inserted between the first thermal dissipation member and the second thermal dissipation member.

Also, the first thermal dissipation member is bowl-shaped and has a flat bottom, the second thermal dissipation member includes a cylindrical part, the thermal insulation member is plate-like, the light emitting module is attached onto an inner surface of the bottom of the first thermal dissipation member, the circuit unit is housed in the cylindrical part of the second thermal dissipation member, and the thermal insulation member is inserted between an outer surface of the bottom of the first thermal dissipation member and one of ends of the cylindrical part of the second thermal dissipation member.

In this case, the cylindrical part may be circular cylindrical, and the thermal insulation member may be discoid.

Furthermore, the second thermal dissipation member includes a small circular cylindrical part that extends from the other end of the cylindrical part, is smaller in diameter than the cylindrical part, and the small circular cylindrical part has a base attached thereto that is electrically connected to the circuit unit.

Also, the thermal insulation member has formed therein at least one through-hole passing through in a thickness direction thereof, and the first dissipating member and the second dissipating member are fastened to each other via a fastening member inserted into the through-hole.

Advantageous Effects of Invention

According to the light source device relating to the present invention having the above structure, heat generated by the light emitting module during lighting is conducted to the first thermal dissipation member onto which the light emitting module is attached. Then, the heat is distributed throughout the first thermal dissipation member to be dissipated from a surface of the first thermal dissipation member. On the other hand, heat generated by the circuit unit is conducted to the second thermal dissipation member by radiation, convection within the case, or the like. Then, the heat is distributed throughout the second thermal dissipation member to be dissipated to an ambient space through the outer circumferential surface of the second thermal dissipation member. In this case, the thermal insulation member is inserted between the first thermal dissipation member and the second thermal dissipation member. This prevents, as much as possible, conduction of heat generated by the light emitting module to the second thermal dissipation member and conduction of heat generated by the circuit unit to the first thermal dissipation member. Accordingly, it is possible to eliminate thermal effects between the light emitting module and the circuit unit as much as possible so as to ensure thermal dissipation properties of the light emitting module and the circuit unit which are provided for the member light emitting module and the circuit unit, respectively.

DESCRIPTION OF EMBODIMENTS

The following describes an embodiment of the present invention with reference to the drawings.

Figure 1:
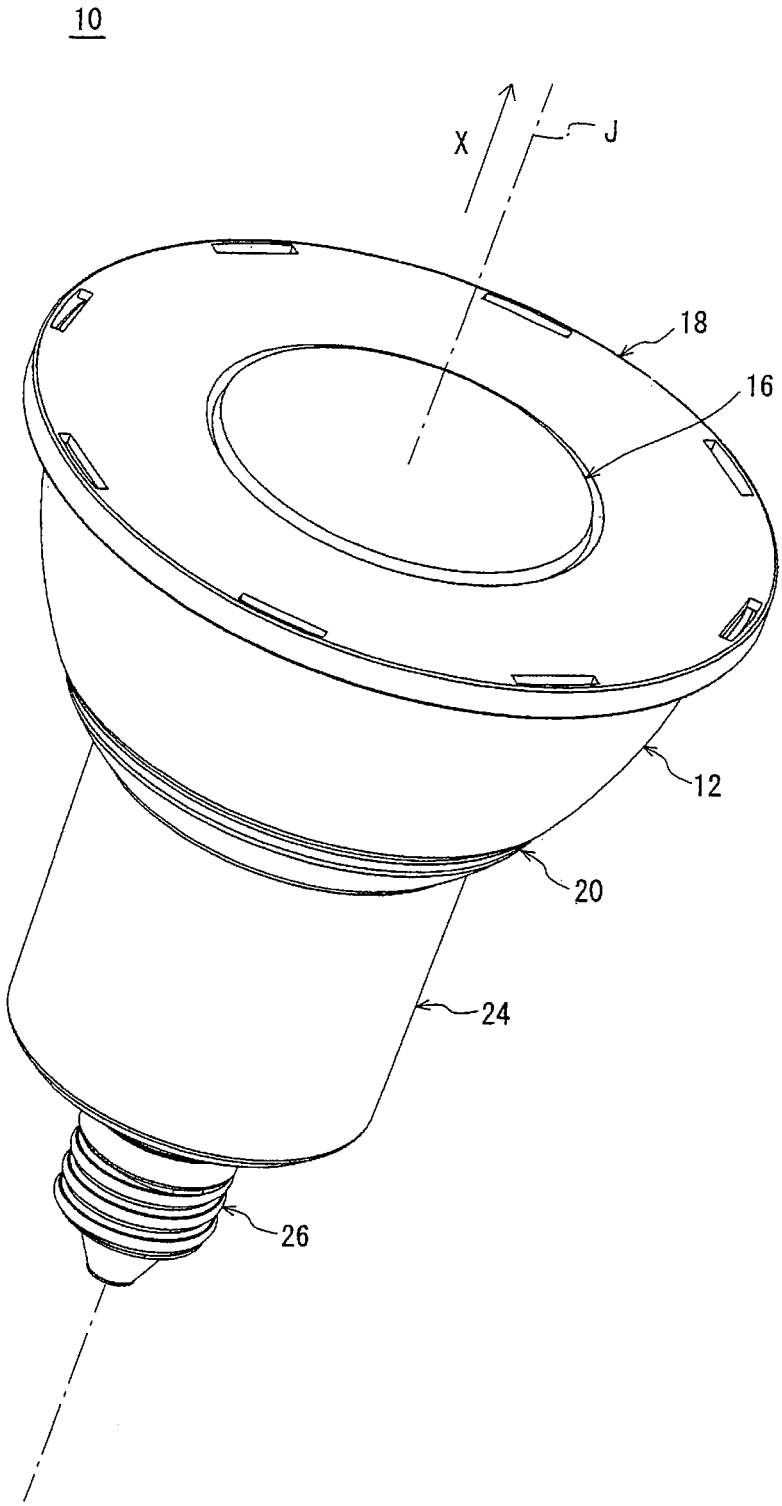
FIG. 1 is a perspective view of an LED lamp relating to an embodiment.
Figure 2:
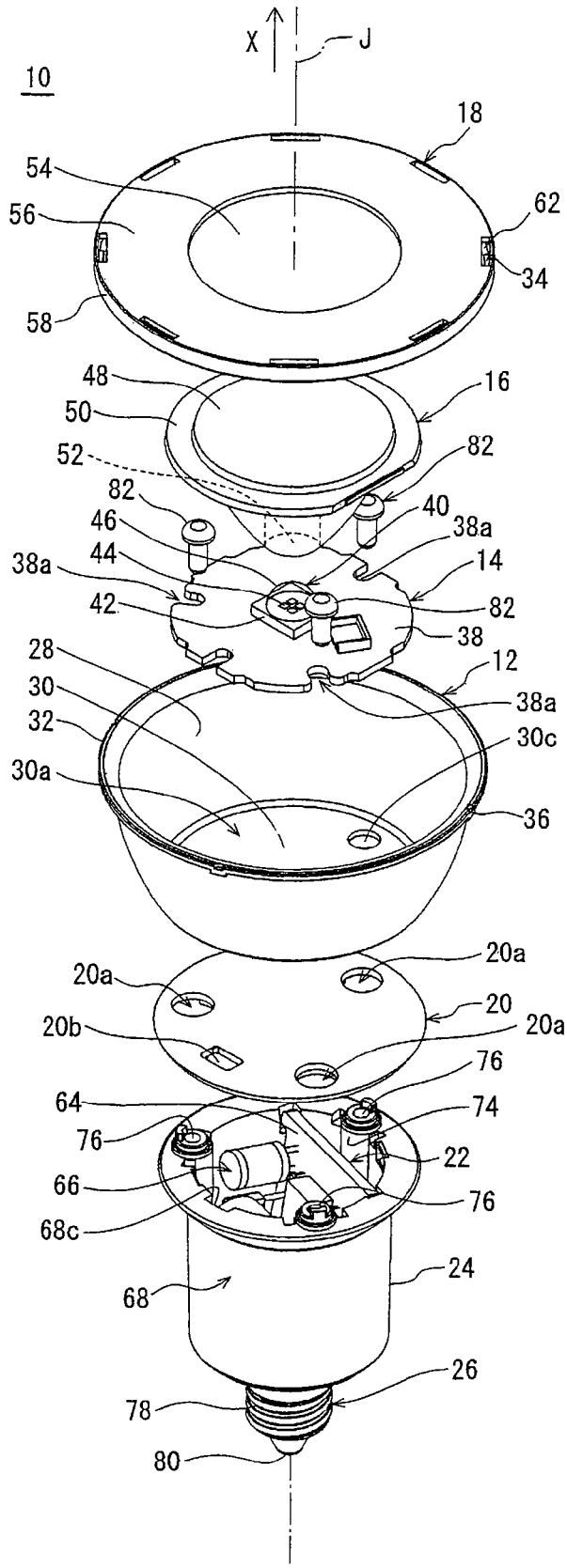
FIG. 2 is an exploded perspective view of the LED lamp.
Figure 3:
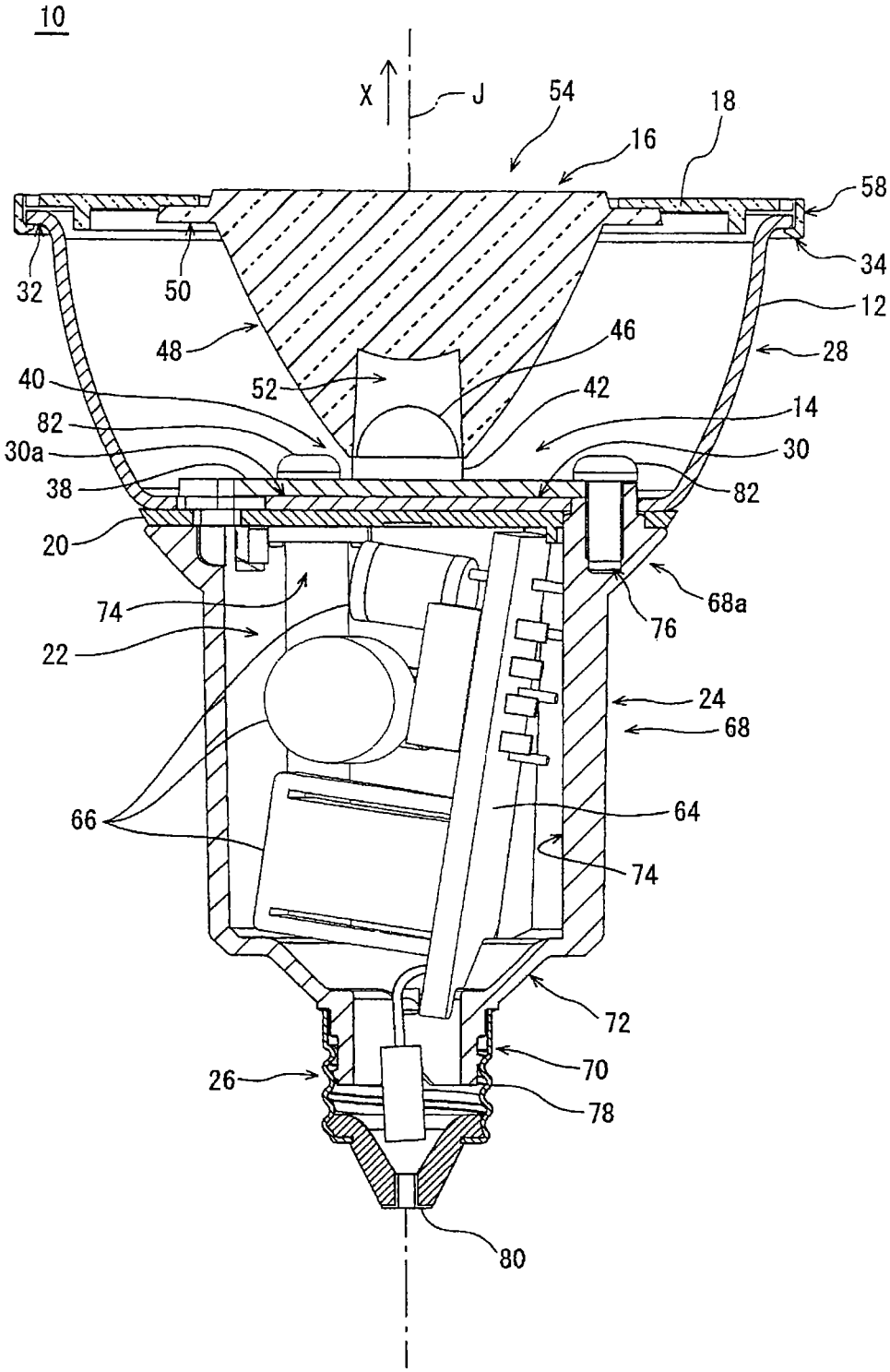
FIG. 3 is a longitudinal sectional view of the LED lamp.

FIG. 1-FIG. 3 are a perspective view, an exploded perspective view, and a longitudinal sectional view of an LED lamp 10 as an example of a light source device, respectively. Note that the scale ratio between members differs among FIG. 1-FIG. 3 and FIG. 4 which is later described. Also, part of members is shown without being cut in FIG. 3. Furthermore, in the drawings, a dashed line represents a lamp axis J, and a direction, which is parallel to the lamp axis J and is indicated by an arrow X, is toward the front side of the LED lamp 10 and is also a lighting direction.

(Schematic Structure)

The LED lamp 10 is used as a substitute for a halogen bulb having a reflecting mirror. That is, the LED lamp 10 has a similar outer appearance to a halogen bulb having a reflecting mirror, as shown in FIG. 1. Also, the LED lamp 10 includes a base 26, and includes therein a circuit unit 22 (FIG. 2 and FIG. 3). The LED lamp 10 is used by being attached to lighting equipment to which a halogen bulb having a reflecting mirror should be attached.

As shown in FIG. 2, the LED lamp 10 includes, in addition to the circuit unit 22 and the base 26, a body 12, a light emitting module 14, an optical member 16, a front cover 18, a thermal insulation member 20, and a case 24.

(Body)

The body 12 is bowl-shaped, and has a cylindrical part 28 and a bottom 30. The cylindrical part 28 increases in diameter from the back to the front. The bottom 30 is discoid (plate-like), and closes the back end of the cylindrical part 28. In other words, the body 12 is bowl-shaped, and has the bottom 30 that is flat. The cylindrical part 28 has a circular cross-section taken along a plane perpendicular to the lamp axis J, and has (that is, the body 12 has) a central axis that coincides with the lamp axis J.

Note that the bottom 30 is not limited to be discoid. Alternatively, the bottom 30 may be, for example, in the shape of an elliptical plate, a rectangular plate, or a polygonal plate.

The bottom 30 of the body 12 has an inner surface 30*a* onto which the light emitting module 14 is attached. The body 12 is made of a metal having excellent thermal conduction properties such as aluminum, and functions as a thermal dissipation member (first thermal dissipation member) for exclusively dissipating heat generated by the light emitting module 14. Note that, the body 12 may be made of a resin or ceramic having excellent thermal conduction properties. Also, the body 12 has housed therein an optical member 16. The use of a light transmissive material for the body 12 allows light irradiation of the body 12 itself and light irradiation toward the back side of the body 12. This improves the quality of the outer appearance of the LED lamp 10 in use.

The cylindrical part 28 has an annular flange 32 at the end of an opening thereof, which extends in a direction perpendicular to the lamp axis J.

The front cover 18 is attached to the body 12 via claws 34 engaging with the flange 32. Furthermore, the flange 32 has a plurality of protrusions 36 on the back surface thereof at intervals in a circumferential direction thereof. Provision of the protrusions 36 prevents idle rotation of the front cover 18 relative to the body 12. That is, when the front cover 18 rotates about the lamp axis J, the claws 34 abut with the respective protrusions 36. Accordingly, the front cover 18 does not rotate relative to the body 12 anymore. Note that an arbitrary number of the protrusions 36 may be provided.

(Light Emitting Module)

The light emitting module 14 includes a module substrate 38 and an LED unit 40 mounted substantially at the center on the module substrate 38, and is mounted substantially at the center on the inner surface 30*a* of the bottom 30 of the body 12. The LED unit 40 includes, for example, a unit substrate 42, LED chips 44 mounted on the unit substrate 42, a phosphor provided on the LED chips 44, and a semispherical sealing member 46 sealing the LED chips 44. The LED chips 44 are each, for example, an InGaN LED chip emitting blue light, and the phosphor is an yellow-green phosphor. With this structure, part of blue light emitted from the LED chips 24 is converted to yellow-green light by the phosphor, and the converted yellow-green light and remaining unconverted part of the blue light are mixed so as to be emitted as white light.

(Optical Member)

The optical member 16 is, for example, made of a translucent material such as a transparent acrylic resin, and includes a lens part 48 in the shape of a substantially conical frustum and an outer edge part 50 in the shape of a substantially annular plate, which are integrally molded. The outer edge part 50 extends along a circumferential surface of the lens part 48.

The lens part 48 is positioned at substantially the center of the body 12 and toward the front side of the light emitting module 14. The lens part 48 has a concave 52 that is substantially circular cylindrical at a back end thereof. By fitting the sealing member 46 of the LED unit 40 into the concave 52, the position of the optical member 16 relative to the LED unit 40 is determined.

Light emitted from the light emitting module 14 mainly enters the lens part 48 through the concave 52, passes through the lens part 48, and is extracted to the outside of the body 12 from the front surface of the lens part 48. The course of the light emitted from the light emitting module 14 changes while the light passes through the lens part 48. Specifically, the emitted light is focused by the lens part 48 thereby to be a spotlight similar in light distribution properties to light emitted from a halogen bulb having a reflecting mirror. Note that the front surface of the lens part 48 has been subjected to light diffusion process so as to be provided with a plurality of convexes and concaves for diffusing emitted light.

The outer edge part 50 is positioned toward the back of the front cover 18 so as to close the opening of the body 12. The front surface of the outer edge part 50 and the back surface of the front cover 18 are in face-to-face contact with each other. Since the circumferential unit 32 and the front cover 18 are in surface contact with each other, heat conducted to the optical member 30 easily escapes through the front cover 18. This allows heat generated by the LED unit 40 to efficiently release from the front cover 18 to the outside via the optical member 16. In the case where the front cover 18 is translucent, a small amount of light leaked from the optical member 16 can pass through the front cover 18. This produces an effect of light irradiation of the whole front surface of the lamp.

(Front Cover)

The front cover 18 includes, for example, a main part 56 and a circumferential wall 58. The main part 56 is in the shape of an annular plate, and has a light emission window 54 that is substantially circular. The circumferential wall 58 is in the shape of a short cylinder, and extends toward the back side from an outer circumferential edge of the main part 56. Note that the shape of the front cover 18 is not limited to the above shape, and may be any shape in accordance with the shape of the opening 11 of the body 12.

The front cover 18 is made of a non-translucent resin material such as white PBT (polybutylene terephthalate). PBT is a preferable material for the front cover 18 because having a high thermal resistance, a moderate elasticity, and an excellent weather resistance. The resin that constitutes the front cover 18 is not limited to PBT, and may be acrylic, PC (polycarbonate), or the like. Also, the front cover 18 is not limited to be white, and may have any color. The front cover 18 may be transparent or translucent.

The circumferential wall 58 is provided with the plurality of claws 34 at intervals in the circumferential direction thereof. For example, the claws 34 are provided at regular intervals near a back end edge of an inner circumferential surface of the circumferential wall 58 in the inner circumferential direction of the circumferential wall 58, so as to project toward the lamp axis J. Note that an arbitrary number of the claws 34 may be provided.

The main part 56 is provided with holes 62 at positions corresponding to the respective claws 34. Provision of the holes 62 allows resin-molding of the front cover 18 having a complicated shape with use of a simple mold composed of a smaller number of parts.

The front cover 18 forces the optical member 16 backward. This brings the front cover 18 and the outer edge part 50 in face-to-face contact with each other, and makes the lens part 48 to abut with the light emitting module 14. This controls the movement of the optical member 16 backward and forward, thereby to prevent the positional shift and backlash of the optical member 16.

(Thermal insulation Member)

The thermal insulation member 20 is discoid, has substantially the same size as the bottom 30 of the body 12, and has thermal insulation properties literally. Here, a member having a thermal conductivity of less than 10 W/mK is defined as having thermal insulation properties, and a member having a thermal conductivity of 10 W/mK or higher is defined as having thermal conduction properties. Accordingly, the thermal insulation member 20 is made of a member having a thermal conductivity of less than 10 W/mK, and the body 12 that is the first thermal dissipation member and the case 24 that is the second thermal dissipation member are each made of a member having a thermal conductivity of 10 W/mK or higher.

The thermal insulation member 20 is, for example, made of a synthetic resin such as PBT, PET, PC, and PPS.

The thermal insulation member 20 is inserted between the body 12 that is the first thermal dissipation member and the case 24 that is the second member so as to insulate the body 12 and the case 24.

The thermal insulation member 20 also has a function of electrically insulating the circuit unit 22 and the body 12.

In the above example, the thermal insulation member 20 has substantially the same size as the bottom 30 of the body 12, as shown in FIG. 3. That is, the thermal insulation member 20 has substantially the same diameter as the bottom 30. Alternatively, the thermal insulation member 20 may have a diameter larger than the diameter of the bottom 30 such that the circumferential edge of the thermal insulation member 20 protrudes outside the bottom 30. Further alternatively, the thermal insulation member 20 may have a diameter smaller than the diameter of the bottom 30 such that the circumferential edge of the thermal insulation member 20 is positioned entirely inside the circumferential edge of the bottom 30.

In the case where the bottom 30 of the body 12 is not discoid as described above, the thermal insulation member 20 may be in the shape of an elliptic plate, a square plate, a polygonal plate, or the like, in accordance with the shape of the bottom 30 of the body 12.

(Circuit Unit)

The circuit unit 22 includes, for example, a lighting circuit that is provided with a rectifier circuit that rectifies an AC power supplied from a commercial power source to a DC power and a voltage adjustment circuit that adjusts a voltage value of the DC power rectified by the rectifier circuit. The circuit unit 22 is electrically connected to the base 26 and the LED unit 40, receives power from lighting equipment (not illustrated) via the base 26, and causes the LED chips 44 of the LED unit 40 to emit light.

The circuit unit 22 is composed of a circuit board 64 and a plurality of electronic components 66 mounted on the circuit board 64, and is housed in the case 24.

(Case)

The case 24 is made of a material having electrical insulating properties and thermal conduction properties. The case 24 is, for example, made of a resin to which a heat conductive filler has been added, a ceramic having a high thermal conductivity, or the like. The case 24 functions as a thermal dissipation member (second thermal dissipation member) dissipating heat generated by the circuit unit 22 housed in the case 24.

The case 24 includes a large circular cylindrical part 68, a small circular cylindrical part 70 that is smaller in diameter than the large circular cylindrical part 68, and a taper cylindrical part 72 connecting the large circular cylindrical part 68 and the small circular cylindrical part 70. The large circular cylindrical part 68 has a flange 68*a* extending in a diameter direction thereof on the edge of an opening thereof.

The case 24 has three bulged-out portions 74 that each protrude along an internal wall thereof in the axis direction thereof to form a semicircular cylindrical shape. The case 24 has three pilot holes 76 for screws 82 at respective thicker portions within a range from the respective bulged-out portions 74 to the flange 68*a* (FIG. 2).

As shown in FIG. 3, most parts of the circuit unit 22 are housed in the large circular cylindrical part 68.

Note that the shape of the large circular cylindrical part 68 is not limited to be a circular cylindrical shape, and may be other cylindrical shape. In the case where the bottom 30 of the body 12 and the thermal insulation member 20 are each not discoid as described above, the large circular cylindrical part 68 may be in the shape of an elliptic cylinder, a square cylinder, a polygonal cylinder, or the like, in accordance with the shape of the bottom 30 of the body 12 and the thermal insulation member 20.

(Base)

The base 26 is a member for allowing the LED lamp 10 attached to lighting equipment to receive power from a socket (not illustrated). The base 26 is an E11 base, which is one type of Edison bases, in the present embodiment. Alternatively, the base 26 may not be especially limited to this type. The base 26 is substantially circular cylindrical, and includes a shell 78 whose outer circumferential surface functions as a male screw and an eyelet 80. The base 26 is attached to the small circular cylindrical part 70 by being fit onto the small circular cylindrical part 70.

(Assembly of Light Source Device)

The case 24 in which the circuit unit 22 is housed, the thermal insulation member 20, the body 12, and the light emitting module 14 are assembled by being fastened to one another via a plurality of screws 82 (three screws 82, in the present embodiment). The screws 82 are each a tapping screw. The number of the screws 82 may be one. The number of each of cuts 38*a*, through-holes 30*c*, through-holes 20*a*, and pilot holes 76, which are described later, is adjusted depending on the number of the screws 82.

As shown in FIG. 2, the bottom 30 of the body 12 is provided with the plurality of through-holes 30*c* for fastening the screws 82 and a wiring hole (not illustrated) for wiring. Also, the thermal insulation member 20 is provided with the plurality of through-holes 20*a* and a wiring hole 20*b*. Furthermore, the module substrate 38 of the light emitting module 14 is provided with the plurality of U-shaped cuts 38*a*. The screws 82 are inserted through the cuts 38*a* of the module substrate 38, the through-holes 30*c* of the body 12, and the through-holes 20*a* of the thermal insulation member 20 in this order. Then, the screws 82 are further inserted into the pilot holes 76. This forms a female screw in each of the pilot holes 76, thereby to integrally assemble the body 12, the light emitting module 14, the thermal insulation member 20, and the case 24.

Moreover, a wiring (not illustrated) of the light emitting module 14 is inserted through the case 24 via the wiring hole (not illustrated) provided on the bottom 30 of the body 12 and the wiring hole 20*b* of the insulation member 20, so as to be electrically connected to the circuit unit 22. The flange 68*a* of the case 24 has a recess 68*c* on an internal circumferential surface thereof, which communicates with an internal space of the case 24. The wiring passes through the recess 68*c*, and this determines a predetermined position of the light emitting module 14 in the case 24.

Note that the screws 82 are each not limited to a tapping screw. Alternatively, a general machine screw may be used. In the case where such a machine screw is used, a female screw to be engaged with the machine screw needs to be formed instead of the pilot hole 76.

Further alternatively, other fastening member may be used such as a rivet.

According to the LED lamp 10 having the above structure, heat generated by the light emitting module 14 during lighting is conducted to the body 12 that is the first thermal dissipation member onto which the light emitting module 14 is attached. Then, the heat is dissipated from the surface of the body 12. On the other hand, heat generated by the circuit unit 22 is conducted to the case 24 that is the second thermal dissipation member by radiation, convection within the case 24, or the like. Then, the heat is dissipated to an ambient space through the outer circumferential surface of the case 24 or to lighting equipment to which the LED lamp 10 is attached via the base 26.

In this case, the thermal insulation member 20 is inserted between the body 12 and the case 24. This prevents, as much as possible, conduction of heat generated by the light emitting module 14 to the case 24 and conduction of heat generated by the circuit unit 22 to the body 12. Accordingly, it is possible to eliminate thermal effects between the light emitting module 14 and the circuit unit 22 as much as possible, thereby to ensure thermal dissipation properties of the light emitting module 14 and the circuit unit 22.

[Modification]

Figure 4:
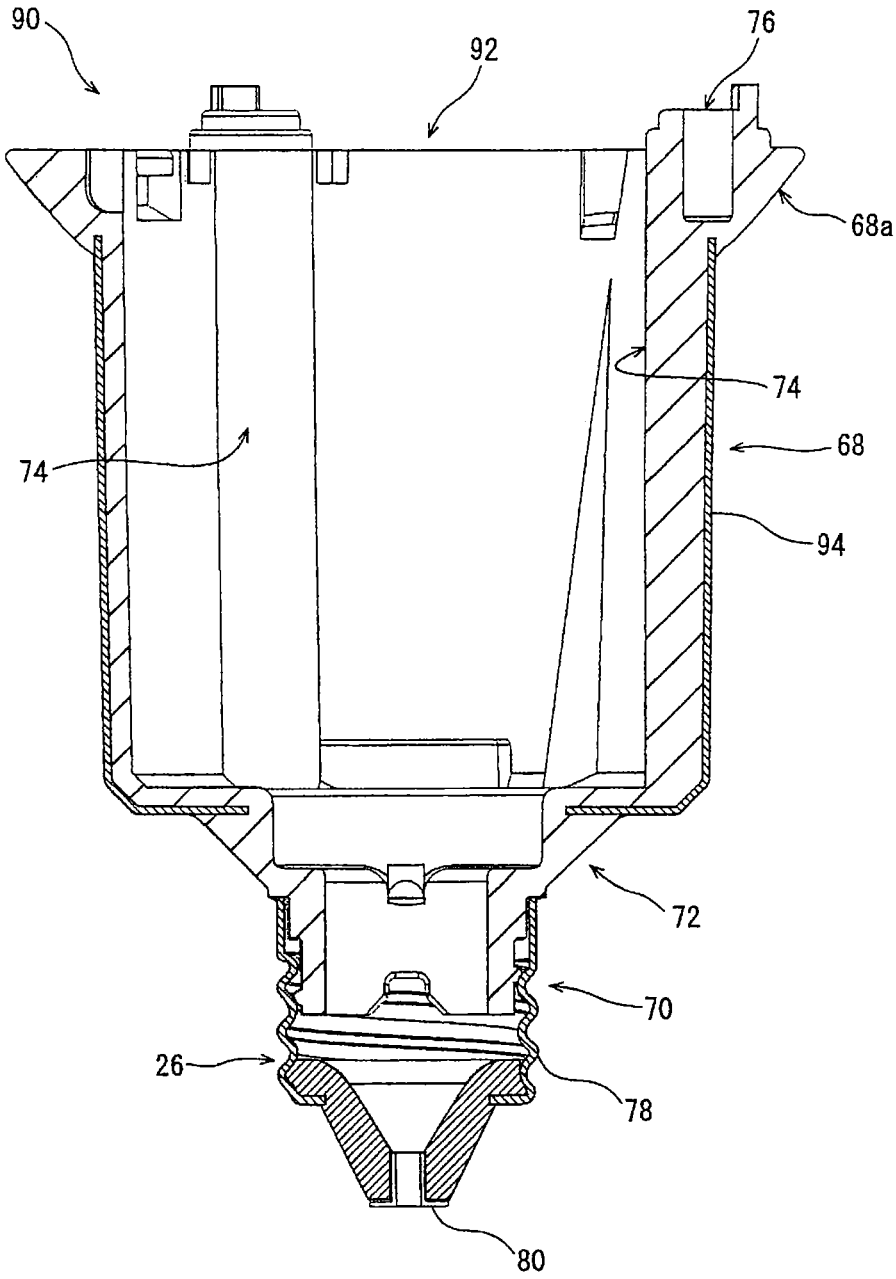
FIG. 4 is a cross-sectional view of a case constituting an LED lamp relating to a modification.

FIG. 4 is a cross-sectional view of a case 90 constituting an LED lamp relating to a modification. The LED lamp relating to the modification has the same structure as the LED lamp 10 excepting the case. Accordingly, description of the structure excepting the case is omitted.

Also, the case 90 has the same structure as the case 24 (FIG. 3) excepting that the case 90 includes a metal cylinder 94 described later. Thus, components of the case 90 shown in FIG. 4, which are substantially the same as those of the case 24, have the same referential numerals as those of the case 24. Accordingly, description thereof is omitted.

The case 90 is composed of a main part 92 made of a synthetic resin and the metal cylinder 94.

In the case where a case for housing a circuit unit is made of a synthetic resin, abnormal heat generation by the circuit unit due to some defect might partially melt the case to create a hole in the case. Such a state where the case has the hole is visible as a modified outer appearance of the LED lamp, and this makes a user to feel anxious.

In view of this, there is a demand for an LED lamp whose outer appearance is not modified (that is, any modified part is invisible) due to abnormal heat generation by a circuit unit.

In response to the demand, there has been proposed to cover, with a metal cylinder, an outer circumference (a part where a hole might be created) of a case made of a synthetic resin. However, just covering leads to the increase in size of the LED lamp by the size of a space between the metal cylinder and the resin case. Although, on the contrary, there has been proposed to downsize the resin case, a problem occurs such as an insufficient space for housing the circuit unit.

In view of this, according to the case 90 of the LED lamp relating to the modification, when the main part 92 is injection-molded, insert-molding is performed such that the metal cylinder 94 is partially embedded in the main part 92 so as to be connected to each other.

That is, the case 90 for housing the circuit unit 22 is composed of the main part 92, which is made of a synthetic resin and has a cylindrical part, and the metal cylinder 94 which is partially embedded in the body 92 by insert-molding and has a circular cylindrical part covering an outer circumferential surface of the cylindrical part in close contact with the outer circumferential surface.

By covering the main part 92 with the metal cylinder 94 connected thereto by insert-molding, the metal cylinder 94 comes in close contact with the outer circumferential surface of the main part 92 with no space therebetween. This makes it possible to prevent the increase in size of the case resulting from providing the metal cylinder.

Also, since the parts of the metal cylinder 94 (one end part of the circular cylindrical part and the other end part of the circular cylindrical part that is folded back inward) is embedded in the main part 92, the metal cylinder 94 is prevented from dropping out from the main part 92. Furthermore, the metal cylinder 94 is integrally assembled with the main part 92. This requires less trouble compared with a case where a metal cylinder is joined to a main part using adhesive.

The metal cylinder 94 preferably has excellent thermal conduction properties in order to ensure thermal dissipation properties, and is made of aluminum for example.

INDUSTRIAL APPLICABILITY

The light source device relating to the present invention is, for example, preferably usable as a substitute for a halogen bulb having a reflecting mirror.

REFERENCE SIGNS LIST

10 LED lamp
12 body
14 light emitting module
20 thermal insulation member
22 circuit unit
24 case

The invention claimed is:

1. A light source device comprising:

a light emitting module;

first thermal dissipation member that is metallic and bowl-shaped, and has a flat bottom having an inner surface onto which the light emitting module is attached, the first thermal dissipation member is integrally formed as a single member;

a circuit unit that is configured to light the light emitting module;

a base that is electrically connected to the circuit unit;

a second thermal dissipation member that is made of an electrically insulating material, and includes a cylindrical part made of resin and has the base attached thereto at one end thereof and an opening at the other end thereof, the cylindrical part having the circuit unit housed therein;

a metal cylinder that is partially embedded in the cylindrical part by insert-molding so as to be separated and electrically insulated from the base, the metal cylinder covering the cylindrical part at a side closer to the other end than the base in close contact with an outer circumferential surface of the cylindrical part; and a thermal insulation member that is inserted between the first thermal dissipation member and the second thermal dissipation member, wherein the thermal insulation member is plate-like, and is provided so as to close the opening of the cylindrical part of the second thermal dissipation member.

2. The light source device of claim 1, wherein the cylindrical part is circular cylindrical, and the thermal insulation member is discoid.

3. The light source device of claim 2, wherein the cylindrical part includes a large circular cylindrical part in which the circuit unit is housed; and a small circular cylindrical part that is smaller in diameter than the large circular cylindrical part, is connected to the large circular cylindrical part, and has the base attached thereto.

4. The light source device of claim 1, wherein the thermal insulation member has formed therein at least one through-hole passing through in a thickness direction thereof, and the first dissipating member and the second dissipating member are fastened to each other via a fastening member inserted into the through-hole.

5. The light source device of claim 1, wherein the cylindrical part is made of a synthetic resin and the cylindrical part has an electrical insulating property and a thermal conductive property.

6. The light source device of claim 5, wherein the cylindrical part is formed as one of an integral synthetic resin part with a heat conducting filler of a ceramic having high thermal conductivity.

* * * * *